US006488188B2

(12) United States Patent
Fleischli

(10) Patent No.: US 6,488,188 B2
(45) Date of Patent: Dec. 3, 2002

(54) COMBINATION BACKPACK AND PROTECTIVE BODY HEAT RETAINING POD

(76) Inventor: Jack A. Fleischli, 3518 Cahuenga Blvd. West, Suite 310, Los Angeles, CA (US) 90068

( * ) Notice: Subject to any disclaimer, the term of this patent is extended or adjusted under 35 U.S.C. 154(b) by 0 days.

(21) Appl. No.: 09/822,928

(22) Filed: Apr. 2, 2001

(65) Prior Publication Data

US 2002/0139821 A1 Oct. 3, 2002

(51) Int. Cl.[7] ..... A45E 4/12; A41D 3/00

(52) U.S. Cl. ..... 224/153; 2/69.5; 224/638; 441/104

(58) Field of Search ..... 441/103, 104; 2/458, 69.5; 224/153, 637, 638

(56) References Cited

U.S. PATENT DOCUMENTS

| | | | | | |
|---|---|---|---|---|---|
| 1,098,110 | A | * | 5/1914 | Herberlein | 2/458 |
| 2,372,110 | A | * | 3/1945 | Noone | 126/204 |
| 2,911,649 | A | * | 11/1959 | Ruelle et al. | 2/69.5 |
| 3,076,206 | A | * | 2/1963 | Shaw et al. | 2/458 |
| 3,155,992 | A | | 11/1964 | Shewmake | |
| 3,768,761 | A | | 10/1973 | Cramer | |
| 4,023,223 | A | * | 5/1977 | Anderson et al. | 2/79 |
| 4,253,198 | A | * | 3/1981 | Estabrook | 2/458 |
| 4,563,777 | A | * | 1/1986 | Park | 2/108 |
| 4,740,183 | A | * | 4/1988 | McKenzie | 441/102 |
| 4,998,296 | A | * | 3/1991 | Stames | 2/458 |
| 5,725,139 | A | * | 3/1998 | Smith | 224/631 |
| 5,860,164 | A | * | 1/1999 | Johnson | 2/108 |
| 5,961,014 | A | * | 10/1999 | Knerr | 224/153 |
| 6,206,744 | B1 | * | 3/2001 | Wigutow | 441/104 |
| 6,328,618 | B1 | * | 12/2001 | Fleischli | 441/106 |

FOREIGN PATENT DOCUMENTS

| | | |
|---|---|---|
| CA | 1245914 | 12/1988 |
| DE | 19601068 A | 7/1997 |
| WO | WO 97-32776 | 9/1997 |

* cited by examiner

*Primary Examiner*—Stephen P. Garbe

(57) ABSTRACT

A protective body heat retaining pod that is carried in a folded condition within a special purpose backpack attached at the rear of a harness that is worn over a conventional life jacket by both civilian and military personnel who find themselves in or about to enter a cold water environment while awaiting rescue from an emergency situation. A hood to be pulled over the head and cinched tightly around the face of the wearer is attached to the back of the protective body heat retaining pod. The protective pod has a sealed body portion that fits around the legs, arms and torso of the wearer within which a small volume of water is trapped and heated by the wearer's body heat to slow a drop in the wearer's body temperature. A cinching cord is attached to the bottom and sides of the protective pod to be pulled upwardly by the wearer, whereby the protective pod is correspondingly pulled upwardly and inwardly to draw and hold the wearer's legs in a fetal position so as to reduce the size of the body portion and thereby minimize the volume of water to be trapped and heated therewithin.

21 Claims, 6 Drawing Sheets

COMBINATION BACKPACK AND PROTECTIVE BODY HEAT RETAINING POD

BACKGROUND OF THE INVENTION

1. Field of the Invention

This invention relates to a protective body heat retaining pod that is stored and transported in a folded up condition within a special purpose backpack so as to be readily accessible to a wearer who finds himself in or about to enter a cold water environment while awaiting rescue from an emergency situation. The protective pod creates a sealed chamber within which a small volume of water is trapped and heated by the wearer's body heat to slow the onset of the effects of hypotherimia and thereby enable the wearer to survive his environment for a longer time.

2. Background Art

As may occur in an emergency situation, a civilian (e.g., a boater, a cruise ship passenger, a pilot, etc.) or a member of the military may find it necessary to abandon his boat or plane. In cases where a boat is at sea or an airplane is above a body of water, the individual may have to enter the water while awaiting rescue. Where the individual must enter a cold water environment wearing nothing more than a conventional life jacket, his body temperature will quickly drop to a level where survival becomes impossible if his rescue is delayed for a prolonged period of time.

My patent application Ser. No. 09/609,674 filed Jul. 3, 2000 disclosed a unique protective body heat retaining pod that is capable of slowing the effect of hypothermia and thereby prolonging the survivability of a civilian or military wearer who is fully immersed in a cold water environment. This protective pod is carried in a folded or rolled up condition within a containment envelope at the back of a personal floatation device (i.e., a life jacket). The pod containment envelope of the life jacket is formed by a series of flaps that are folded over one another to enclose the protective pod. A hood to be worn over the head of the wearer is stored in a rolled up condition within a fold-over collar that runs around the top of the life jacket. The wearer simply lifts up the collar to grab and remove the hood therefrom.

However, in some situations, it may be desirable to make the protective body heat retaining pod independent of the life jacket. Thus, conventional life jackets need not be altered when they are to be used in combination with my protective pod. It may also be desirable to make the hood an integral part of the protective body heat retaining pod, rather than have the hood carried separately under a collar of the life jacket. Therefore, a combination special purpose backpack and protective body heat retaining pod is disclosed below that offers modifications to the invention described in my original patent application so as to achieve the aforementioned objectives.

SUMMARY OF THE INVENTION

Disclosed below is a protective body heat retaining pod which is capable of significantly retarding the loss of a wearer's body heat. The protective pod can be worn by a civilian or military seaman or airman who must enter a cold water environment while awaiting rescue from an emergency situation. The protective pod is preferably manufactured from a readily foldable, highly water resistant ripstop nylon material with a urethane backing. In this regard, and prior to its deployment, the protective pod is carried in a folded configuration within a special purpose backpack that is carried at the wearer's back and is part of a harness to be worn over a conventional life jacket. The backpack has a top cover that is initially closed to prevent an inadvertent removal of the protective pod that is stored therein. A rip cord extends from an easily accessible handle that is located at the front of the harness to the top cover of the backpack. A tether extends from the handle to the protective pod that is folded within the backpack To deploy the protective pod, the wearer grasps and pulls on the handle. The pulling force is applied from the handle to each of the rip cord and the tether to cause the top cover to be opened and the protective pod to be removed from the backpack. The tether prevents the protective pod from floating away from the wearer in hard-to-see conditions following its removal from the backpack.

The wearer dons the protective body heat retaining pod by inserting his legs and torso into a body portion thereof. The wearer then inserts his arms through water-tight sleeves. A vertically extending, water tight zipper along the front of the body portion is zipped up to close the protective pod around the wearer. A hood that is attached to the back of the protective pod is placed over the wearer's head and tightened around his face. A collar at the top of the body portion is wrapped around the wearer's neck and attached to the front of the body portion to prevent outside water from reaching the interior of the pod. A resilient (e.g., bungee) cinching strap is laced in a criss-cross fashion between successive cord holders that run vertically along opposite sides of the body portion. By pulling upwardly on the free ends of the cinching strap, the bottom of the protective pod will be correspondingly pulled upwardly towards the wearer's chest, while the sides of the protective pod will be pulled inwardly around the wearer's legs and waist. By virtue of the foregoing, the wearer's feet will be pulled up and held in a fetal position to facilitate body heat retention and reduce the volume of water that will be trapped within the body portion of the pod. Minimizing the volume of water trapped inside the protective pod directly enhances the ability of the wearer's body heat to warm the water and slow a loss of the wearer's body temperature, thus prolonging his survivability when immersed in a cold water environment while awaiting rescue.

DETAILED DESCRIPTION

Figure 2:
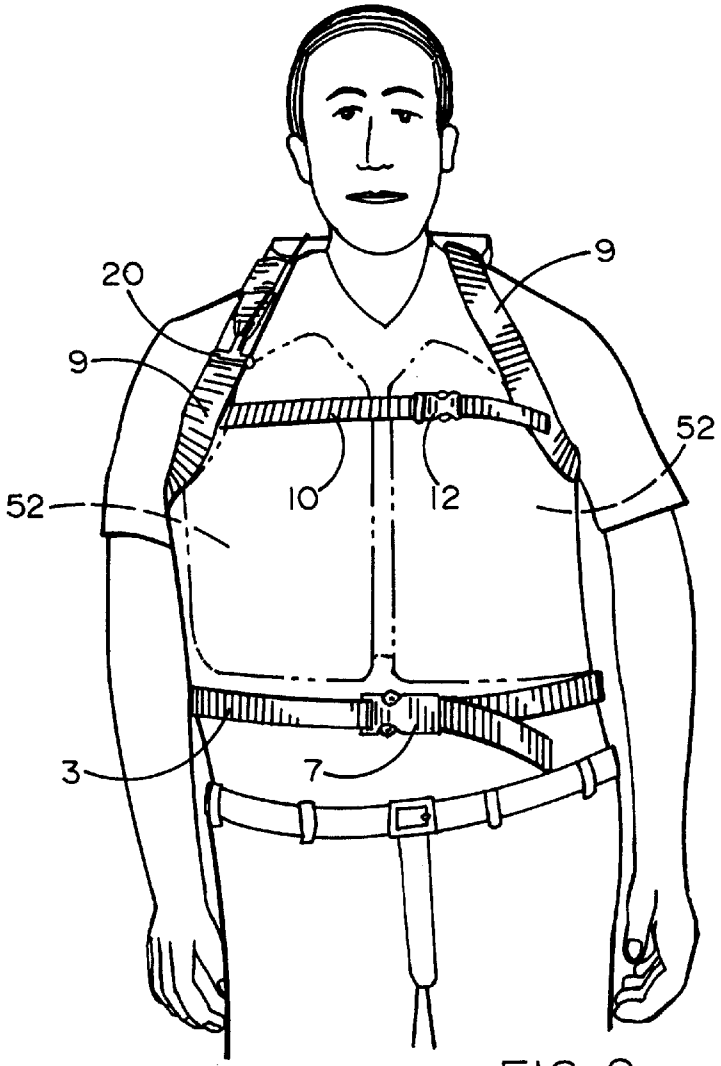
FIG. 2 is a front view showing the harness being worn over the life jacket.
Figure 1:
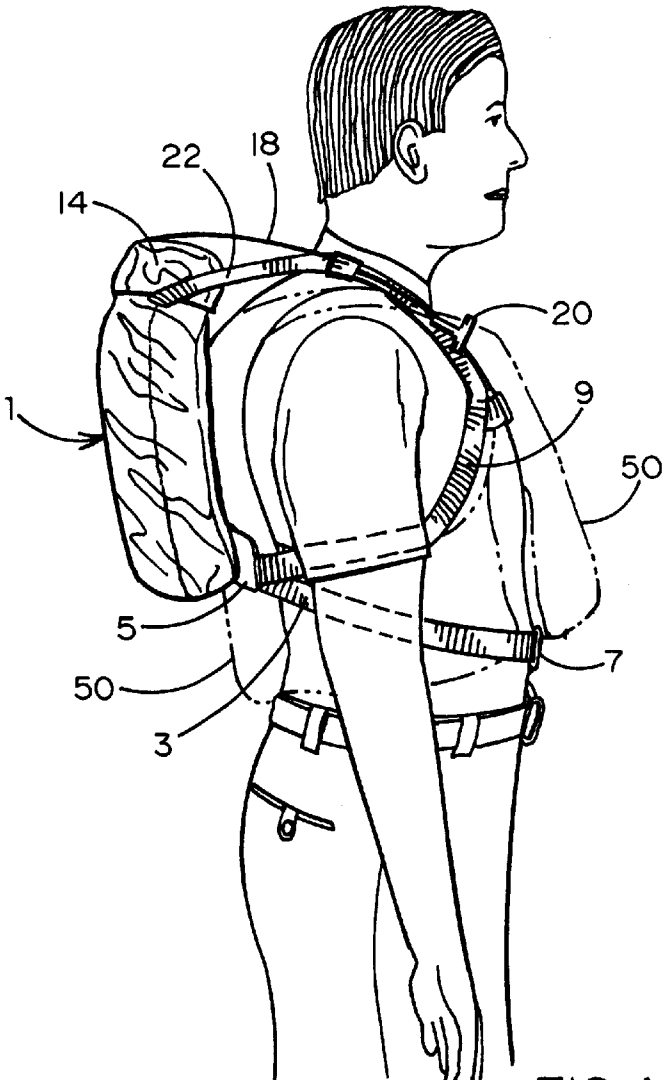
FIG. 1 is a side view showing a harness being worn over a conventional life jacket and carrying a special purpose backpack in which the protective body heat retaining pod of this invention is transported in a folded condition.

The combination backpack and protective body heat retaining pod which forms the present invention is initially described while referring, concurrently to FIGS. 1–4 of the drawings, where details of a special purpose backpack 1 are provided. As will be described in greater detail hereinafter, the backpack 1 has the singular purpose of transporting and providing easy access to a body heat retaining pod (designated 60 in FIGS. 8 and 11).

The backpack 1 is to be worn over a conventional life jacket 50 by civilian or military personnel who may have to enter a cold water environment while awaiting rescue from an emergency situation. For non-military use, such life jacket 50 is typically a Type I, II or III personal floatation device as defined by 46 CFR 160 et seq. The life jacket 50 is preferably manufactured from a light weight water resistant material. A plurality of floatation foam pads 52 (best shown in FIG. 2) are carried within interior compartments of the life jacket to provide the wearer with the buoyancy necessary to remain afloat while drifting in the water. The life jacket 50 is typically closed around the body of the wearer by any combination of draw strings, zippers, buckles and similar fastening devices (not shown).

As will also be described below, the protective pod 60 is folded into a compact package and carried within the backpack 1 behind the wearer. As an important advantage of this invention, the protective pod 60 is stored within the backpack 1 so as to be readily available to the wearer and easily deployed in an emergency situation in order to provide the wearer with the ability to prolong his survival while awaiting rescue in cold water following his evacuation from a boat, plane, helicopter, off-shore platform, etc.

Figure 4:
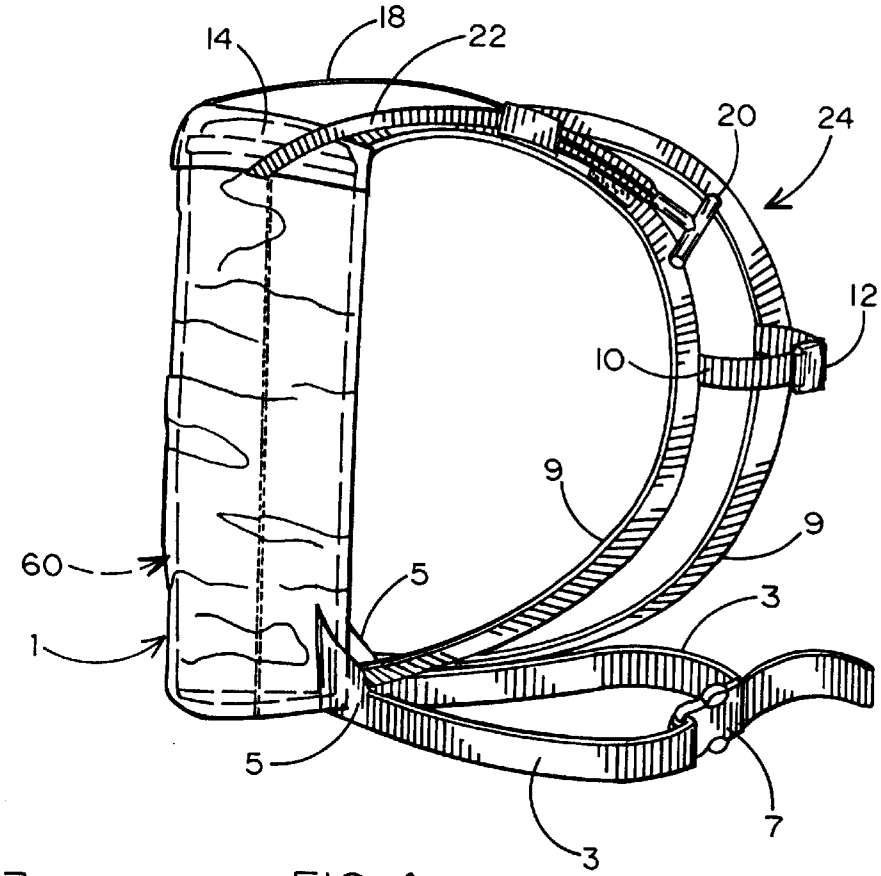
FIGS. 4 and 5 show details of the harness and an easily accessible handle at the front of the harness by which to open the backpack that is carried at the rear of the harness.
Figure 3:
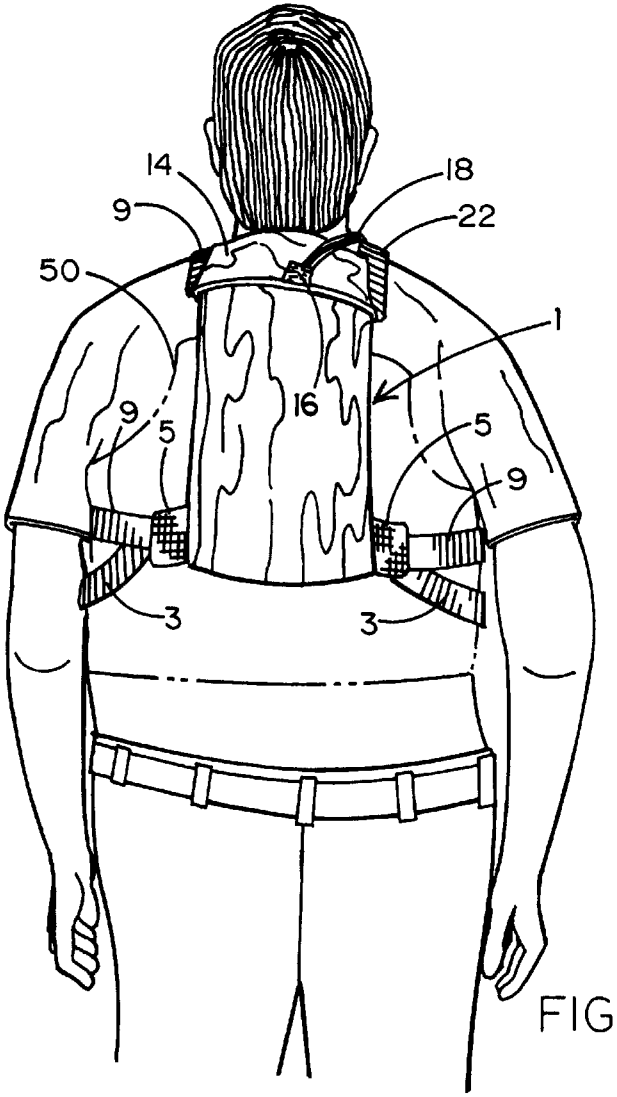
FIG. 3 is a rear view showing the harness carrying the special purpose backpack at the back of the wearer.

The backpack 1 within which the protective pod 60 is transported is held against the back of the wearer and over the life jacket 50 by a belt 3 from a harness 24 best shown in FIG. 4). Rear ends of the belt 3 are attached (e.g., sewn) to respective flaps 5 which project outwardly from the bottom of the backpack 1. Opposite front ends of the belt are detachably connected together around the waist of the wearer by complementary snap-fit buckle sections 7. Opposite rear ends of a pair of shoulder straps 9 of the harness 24 are attached (e.g., sewn) to the flaps 5 at the bottom of backpack 1. The shoulder straps 9 loop under the shoulders of the wearer for attachment to the top of the backpack 1. A cross-strap 10 at the front of harness 24 (best shown in FIG. 2) extends between the pair of shoulder straps 9 across the chest of the wearer. The cross strap 10 is closed by means of complementary snap-fit buckle sections 12.

The special purpose backpack 1 of this invention includes a top cover 14 by which to control access to the protective body heat retaining pod 60 that is stored in and carried at the interior thereof in the configuration of FIGS. 1–4, the top cover 14 of backpack 1 is closed to prevent the pod from being inadvertently removed. The top cover 14 is detachably connected to and closed over the backpack 1 by means of opposing strips of hook and loop fastener material known as Velcro (not shown). A pad 16 is attached (e.g., sewn) to the outside of the top cover 14 of backpack 1. A rip cord 18 run from the pad 16 on the top cover 14 of the backpack 1 at the back of the wearer, over the shoulder of the wearer, to a handle 20 at the front of the harness 24 that is located at an easy-to-reach position along the chest of the wearer. As will be disclosed when referring to FIGS. 6 and 7, the handle 20 can be grasped and pulled by the wearer to open the top cover 14 of the backpack 1 so that the protective body heat retaining pod 60 can be removed therefrom.

A tether 22 runs from the protective body heat retaining pod 60 stored within the backpack 1, over the wearer's shoulder, to the handle 20 at the front of harness 24 to which the rip cord 18 is also connected. The tether 22 performs the dual functions of pulling the protective pod 60 outwardly from the backpack 1 at the same time that the top cover 14 is opened in response to the wearer pulling on the handle 20. In addition, the tether 22 also maintains the protective pod 60 tied to the backpack 1 following its removal from the backpack so as to prevent the pod from floating away from the wearer in the event that the wearer must find the pod in hard-to-see conditions while immersed in a water-filled environment.

As may now be appreciated, the aforementioned belt 3, shoulder straps 9, cross strap 10, rip cord 18 and tether 22 are interconnected with one another and with the backpack 1 and top cover 18 thereof to form a convenient, simple to wear harness 24, as shown in FIG. 4, by which the protective body heat retaining pod 60 may be stored and transported at the back of the wearer and over a conventional life jacket so that the wearer's hands are free to perform other tasks. By virtue of the foregoing, and as will be disclosed while referring to FIGS. 6 and 7, the wearer will have quick and easy access to the protective pod 60 by manipulating the handle 20 should he find himself in the water during an emergency situation.

Figure 5:
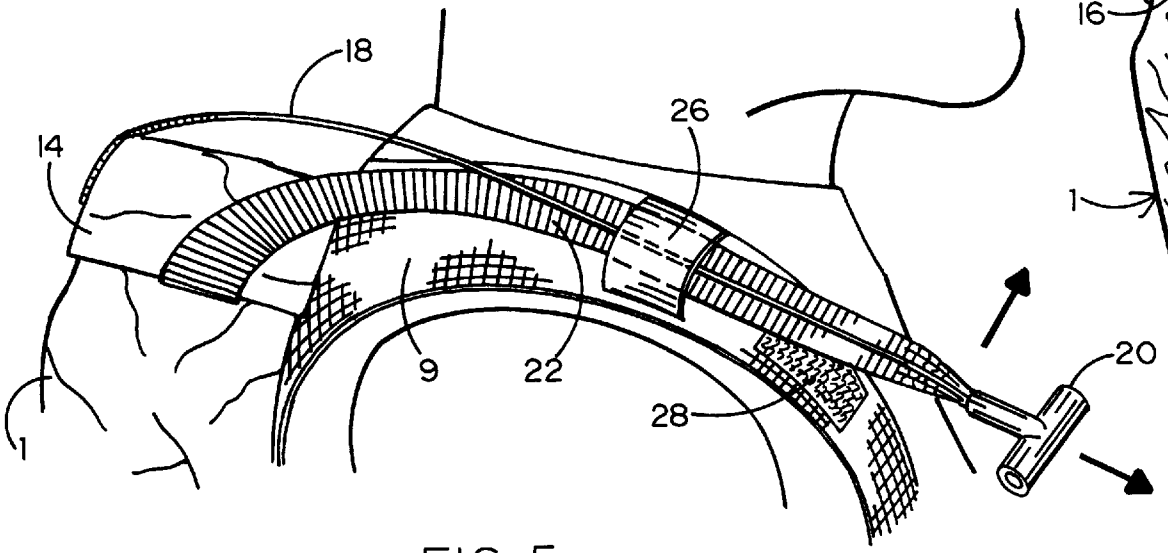

FIG. 5 of the drawings illustrates the connection of the rip cord 18 and the tether 22 to the handle 20 at an easily accessible location near the chest of the wearer at the front of the harness 24. As just described, the rip cord 18 runs from the top cover 14 of the backpack 1 to the handle 20 to enable the top cover to be opened off the backpack. The tether 22 runs from the protective body heat retaining pod 60 carried within the backpack to the handle 20 to prevent the protective pod from drifting away from the wearer once the pod is removed from the backpack during an emergency situation.

To hold the handle 20 at the front of harness 24 at an easily accessible location for the wearer, a belt loop 26 is attached (e.g., sewn) to one of the pair of shoulder straps 9 that supports the backpack 1 over the life jacket 50. A piece of hook and loop Velcro fastener material 28 is attached to the shoulder strap 9 ahead of the belt loop 26. A complementary piece of hook and loop Velcro fastener material (not shown) is attached to the underside of the tether 22. The rip cord 18 and tether 22 are first passed through the belt loop 26, and the tether 22 is then removably attached to the shoulder strap 9 by means of the Velcro fastener 28. Should the wearer need to quickly locate and manipulate the handle 20 of harness 24 to deploy the protective body heat retaining pod 60 within the backpack 1, he simply reaches to his chest where the handle 20 is held in place against shoulder strap 9. By grasping and pulling up on the handle, the rip cord 18 and tether 22 will break free from their attachment to the shoulder strap 9 and Velcro fastener 28.

Figure 6:
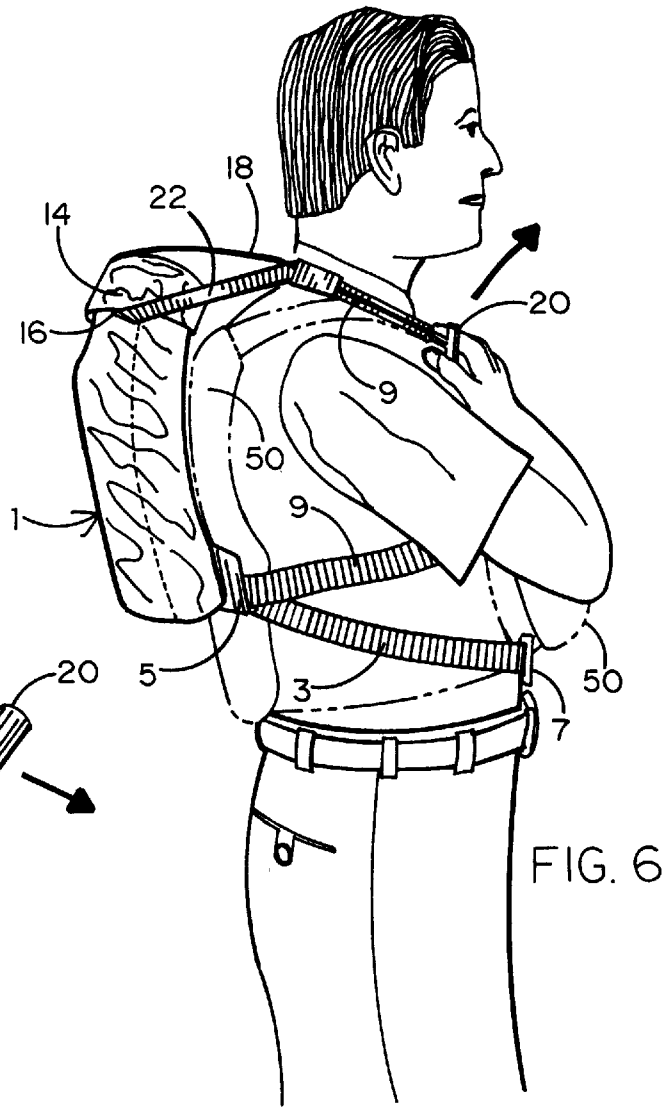
FIGS. 6 and 7 show the wearer manipulating a handle at the front of the harness to open the backpack and remove the protective pod therefrom without first having to remove the backpacks.
Figure 7:
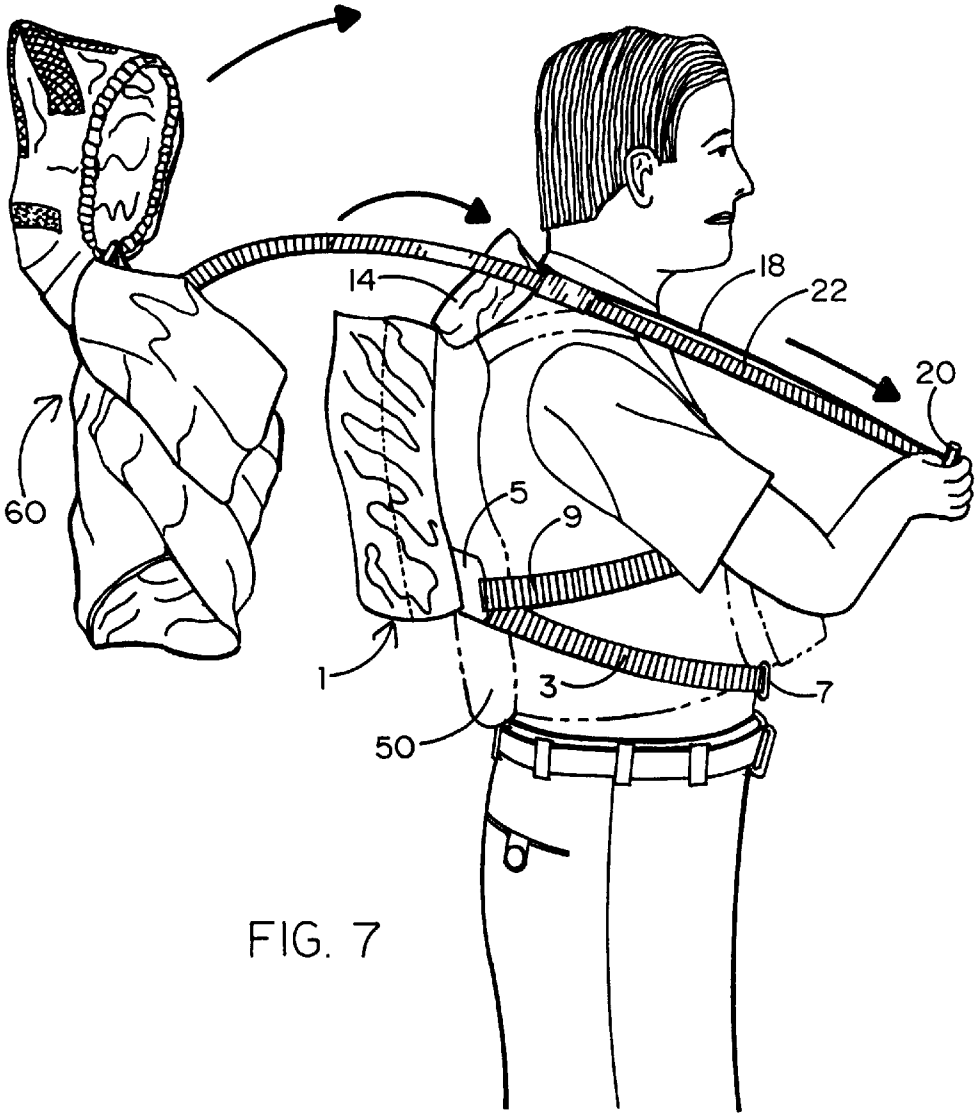

Turning, now to FIGS. 6 and 7 of the drawings, the user is shown gaining access to and manipulating the handle 20 of the harness 24 of FIG. 4 to open the backpack 1 and remove the protective body heat retaining pod 60 therefrom. FIG. 6 shows the wearer pulling upwardly on the handle 20 to correspondingly pull the rip cord 18 and tether 22 off the Velcro fastener 28 (of FIG. 5) and away from the shoulder strap 9. FIG. 7 shows the wearer pulling the handle forwardly and away from his chest. This forward pulling force applied by the wearer to the handle 20 is transferred to the top cover 14 of backpack 1 via rip cord 18, whereby to correspondingly lift the cover 14 off and thereby open the backpack. The forward pulling force applied to handle 20 is also transferred via tether 22 to the protective body heat retaining pod 60 that is folded up and stored within the backpack 1. Accordingly, the protective pod 60 will be automatically pulled out of and removed from the backpack 1 without the wearer having to first remove the backpack or the harness 24 to which the backpack is attached. At this point, the pod 60 will begin to unfold so as to be donned by the wearer to protect himself from his environment. At all times, however, the protective pod 60 will retain tied to the harness 24 via the tether 22.

Although FIGS. 6 and 7 show the wearer deploying the protective body heat retaining pod 60 while in a standing position, it is to be understood that the wearer may already when the handle 20 of harness 24 is manipulated to open the backpack 1 and remove the protective pod 60 therefrom. Thus, the harness 24 enables the wearer to gain easy access to the handle 20 and to quickly find the protective pod 60 once it is pulled from the backpack 1.

Figure 9:
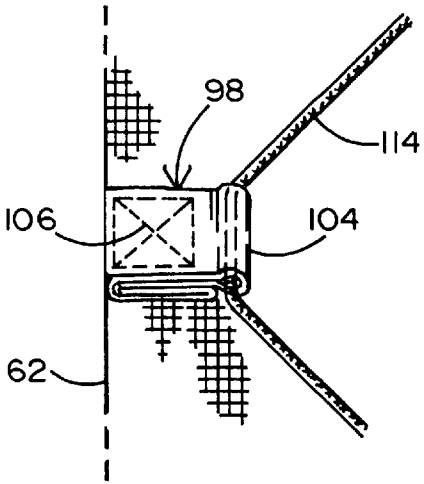
FIGS. 9 and 10 show details of a cord holder by which a resilient cinching cord is laced in criss-cross fashion across the front of the protective pod.
Figure 10:
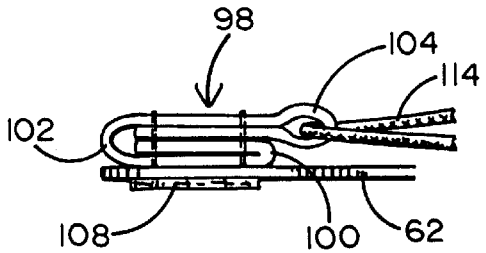
Figure 8:
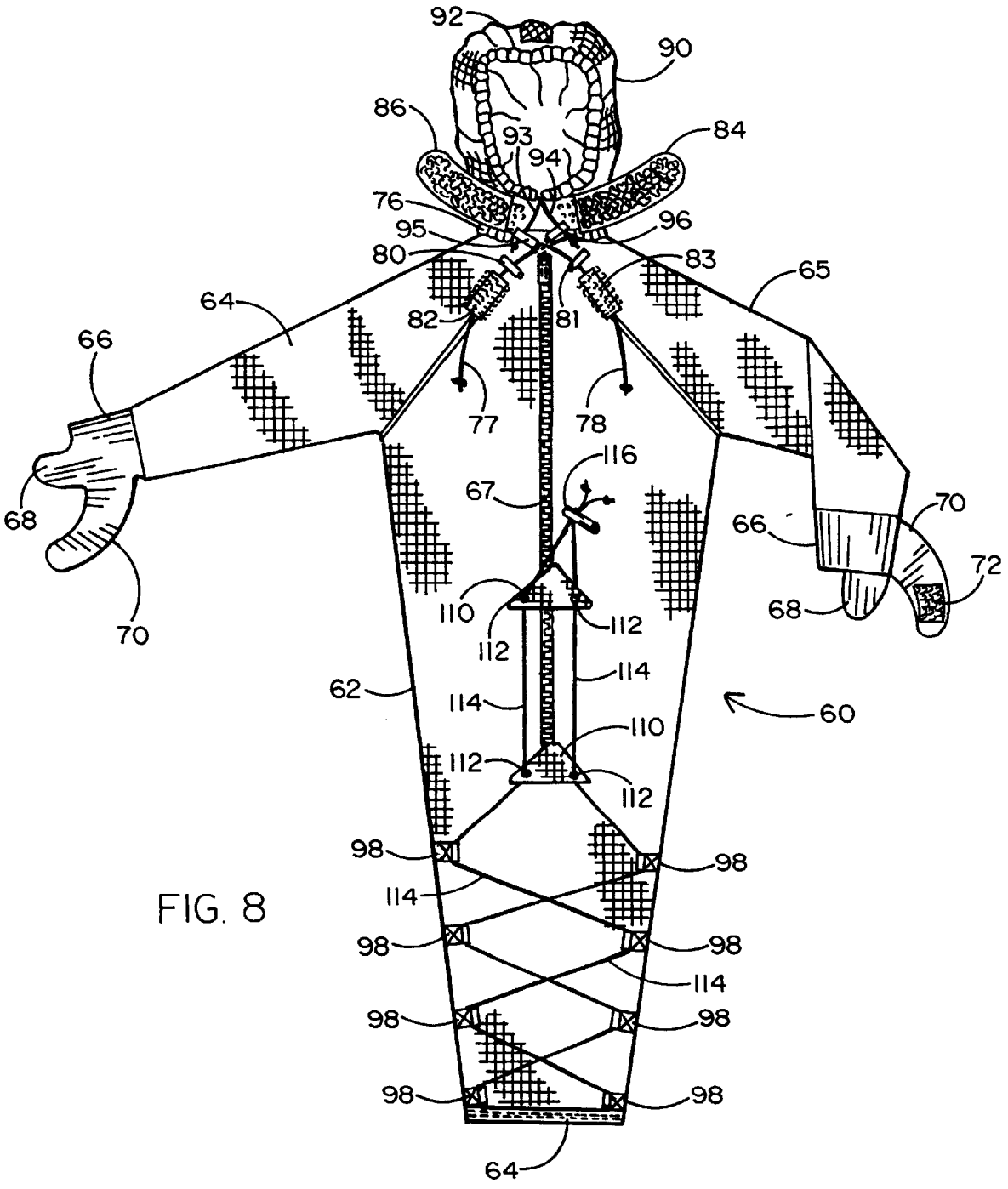
FIG. 8 shows the protective body heat retaining pod in an unfolded, ready to wear configuration.

FIGS. 8–10 of the drawings illustrate details of the protective body heat retaining pod 60 in an unfolded, ready-to-wear configuration following its removal from the backpack 1 where the pod is stored and transported in a folded configuration as represented by FIG. 7. The protective pod 60 disclosed herein is similar, in part, to the protective body heat retaining pod that was described in my pending patent application Ser. No. 09/609,674, the teachings of which are incorporated herein by reference. Therefore, for efficiency, only a brief description of the common features will be described below.

The protective body heat retaining pod 60 is preferably manufactured from an easily foldable, water resistant ripstop nylon material having a urethane backing. Protective pod 60 is intended to be worn in combination with the life jacket 50 (of FIGS. 1–7) but not in substitution thereof. Some or all of the pod 60 may be brightly colored to help locate a wearer who is awaiting rescue in a cold water environment. As best shown in FIG. 8, the protective pod 60 has an adjustable body portion 62 that is sized to surround the arms, legs and torso of a wearer (e.g., either an adult or a child). When the wearer dons the protective pod 60, the life jacket 50 will perform its usual function of keeping the wearer afloat. The primary purpose of pod 60 is to trap a small volume of water within the body portion 62 thereof. The trapped water will eventually be heated by the body heat of the wearer to inhibit the loss of life-sustaining warmth and prevent a rapid drop of the wearer's body temperature while he awaits his rescue.

A closure (e.g., a seam) 64 runs along the bottom of the body portion 62 of the protective body heat retaining pod 60. The body portion 62 is opened and closed by means of a vertically extending, water tight, heavy grade zipper 67. When the zipper 67 is opened, the wearer will be able to climb into (or out of) the protective pod 60 whether the wearer is located on dry land or in water. When the zipper 67 is closed with the wearer located in water, the aforementioned small volume of water will remain trapped at the bottom of the body portion 62.

Extending outwardly and in opposite directions from the body portion 62 of protective pod 60 is a pair of sleeves 64 and 65 that are affixed (e.g., stitched) to the body portion 62 along a diagonal seam. The sleeves 64 and 65 enable excess water to escape the pod 60 as the body portion 62 thereof is compressed for the important purpose to be disclosed below. A pair of cylindrical cuffs 66 are manufactured from a resilient (e.g., neoprene) material and affixed (e.g., stitched) to respective ones of the sleeves 64 and 65. Each cuff 66 is covered with hook and loop Velcro fastener material. A tongue 68 projects axially outward, and a wrist wrap 70 projects radially from each cuff 66. A pod 72 of hook and loop Velcro fastener material is affixed to the end of each wrist wrap 70.

To prevent cold water from entering the body portion 62 via sleeves 64 and 65, the wearer holds onto the tongue 25 to prevent cuff 66 from rotating around his wrist. The wearer then pulls the wrist wrap 70 and winds it snuggly around the cuff 66. The wrist wrap 70 is wound up around itself and over the cuff 66 until the Velcro covered pad 72 is moved into mating engagement with the Velcro covered cuff 66. Accordingly the wrist wrap 70 will be wound securely around itself and tightened against the wearer's wrist to establish a reliable water tight closure (not shown). A pair of diver's wet suit gloves (designated 74 in FIG. 11), or the like, are worn over the cuffs 66 to warm the wearer's hands. The gloves 74 are tethered to the sleeves 64 and 65 by means of respective straps (designated 75 in FIG. 11).

In order to prevent cold water from entering the top of the protective pod 60 where the wearer's neck extends upwardly and outwardly from the body portion 62, a channel 76 runs around the neck of the body portion. A draw string having opposite free ends 77 and 78 is located within channel 76. Thus, when the opposite ends 77 and 78 of the draw string are pulled, the channel 76 and the top of pod 60 will be tightened around the neck of the wearer. Each free end 77 and 78 of the draw string is associated with a conventional push button operated cord stopper that is adapted to prevent such free ends from sliding, inwardly of channel 76 and loosening the water-tight fit of the channel around the wearer's neck. In addition, each free end 77 and 78 of the draw string is received through an elongated loop or tunnel 82 and 83) that is covered with Velcro fastener material for a soon-to-be-described purpose.

The closure at the top of the protective body heat retaining pod 60 is enhanced by means of an elongated collar wrap 84 that is manufactured from a resilient (e.g., neoprene) material and adapted to be stretched when pulled. The collar wrap 84 is affixed (e.g., stitched) to the rear of the body portion 62 of pod 60 below the channel 76. The collar wrap 84 includes a pair of oppositely and outwardly projecting flaps, each of which being covered with Velcro fastener material 86.

Figure 11:
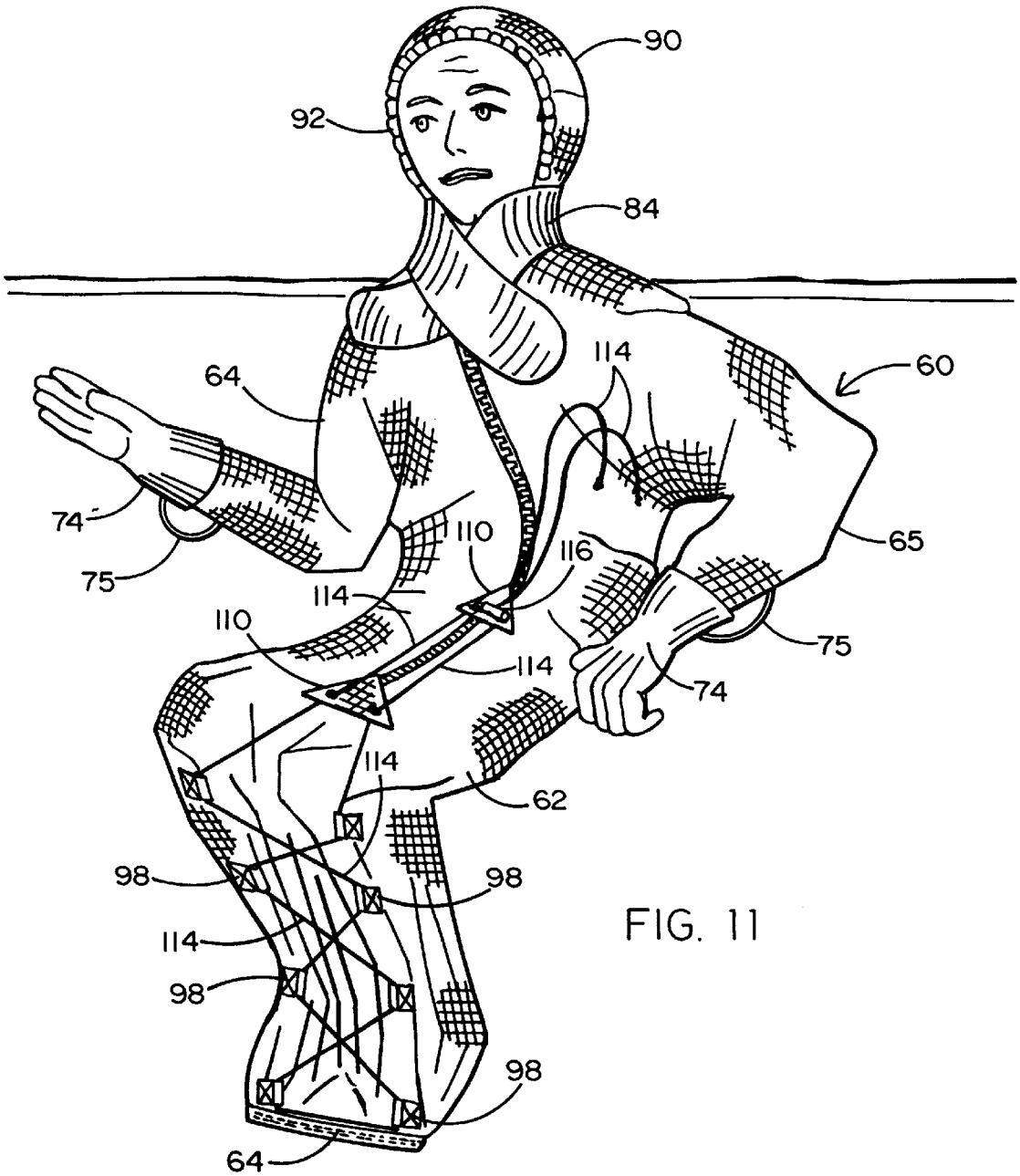
FIG. 11 shows the cinching cord being pulled upwardly to correspondingly pull the protective pod upwardly and inwardly to hold the wearer in a fetal position and reduce the volume of outside water that is trapped within the pod.

Once the wearer has completely donned the protective pod 60, he can pull the collar wrap 84 around his neck to further enhance the water-tight closure in the manner illustrated in FIG. 11. That is, the wearer grasps one of the outwardly projecting resilient flaps of collar wrap 84 and stretches it diagonally across his body so that the Velcro fastener material 86 thereof is moved into detachable mating engagement with the Velcro fastener material which covers one of the draw string loops 83. Next, the wearer grasps the other one of the resilient flaps of collar wrap 84 and stretches it diagonally across his body to be detachably mated to the other draw string, loop 82. Accordingly, the oppositely projecting, flaps of collar wrap 84 cross over one another so as to be held in place above the wearer's chest and at the front of the body portion 62 to improve the capability of the pod 60 to be closed around the neck of the wearer in addition, although it is not completely water-tight, the collar wrap 84 assists in preventing splashed water from entering the interior of the body portion 62.

In accordance with the present modifications, the protective body heat retaining pod 60 is provided with an integral hood 90 to cover the head of the wearer. The hood 90 is attached by virtually water-tight stitching at the rear of the protective pod 60 behind the neck of the body portion 62. Reflecting tape that is capable of reflecting both sunlight and moonlight may be bonded to the hood 90 in order to facilitate a rescue of the wearer in day and evening conditions. A channel 92 surrounds an open window area at the front of the hood 90 at which to receive the face of the wearer. A draw string runs through the channel 92. Opposite free ends 93 and 94 of the draw string may be pulled outwardly to close the channel 92 of hood 90 against the wearer's face and thereby establish a water tight fit. Each of the free ends 93 and 94 of the draw string is associated with a push-button operated cord stopper 95 and 96 to prevent such free ends from sliding inwardly of the channel 92 and loosening the water-tight fit that has been established against and around the face of the wearer.

As earlier disclosed, after the protective body heat retaining pod 60 has been donned in a water-filled environment, a small volume of water will remain trapped within the body portion 62 thereof to be heated by the wearer's body heat. It is an important aspect of this invention to be able to reliably close the body portion 62 around the legs and waist of the wearer to limit the amount of trapped water to a volume which can be efficiently heated in order to prevent the wearer from being subjected to early hypothermia. The foregoing is accomplished by means of a loop and cord system which causes the bottom and opposite sides of the body portion 62 to be pulled upwardly and inwardly to establish a close fit around the legs and waist of the wearer.

More particularly, rows of spaced cord holders 98 are attached at the front of the protective pod 60 along opposite sides of the body portion 62. For high strength, each cord holder 98 is manufactured from nylon strap material. As is best shown in FIGS. 9 and 10, the strap which forms each cord holder 98 is folded back and forth to reinforce its attachment to and prevent a tearing, away from the body portion 62 when a pulling force is applied. That is, the strap from which the cord holder 98 is formed is first turned under itself to lie against the body portion 62 and create a first fold 100. Next, the strap turns back and over top itself to create a second fold 102. Then, the strap once gain turns back and under itself to create a cord loop 104. In the completed configuration, the opposite front and rear ends of the cord holder 98 lie face-to-face one another (best shown in FIG. 10). To prevent an unfolding of the cord holder 98, the opposite front and rear ends thereof are bonded (e.g., burnt).

A box stitch 106 (best shown in FIG. 9) is preferably employed to securely attach the double folded cord holder 98 to the body portion 62 of protective body heat retaining pod 60 at the locations shown in FIG. 8. To prevent the seepage of outside water into the protective pod 60 by way of the stitch holes created by box stitch 106, a thin layer 108 of resilient neoprene material (best shown in FIG. 10) is bonded to the interior of the body portion 62 below the cord holder 98 so as to also receive the box stitch 106 therethrough. The layer 108 of resilient material automatically closes the stitch holes formed therein to prevent leakage and an undesirable increase in the volume of the water that could otherwise fill the body portion 62 and have to be heated by the wearer's body heat. In this regard, it may be appreciated that attaching the double folded cord holder 98 and the cord loop 104 thereof to the protective pod 60 in the manner described above is an improvement over the alternative of creating two lengthy and continuous seams along the lower portion of protective pod 60 which are likely to allow more water to leak into the pod 60.

Returning to the protective body heat retaining pod 60 shown in FIG. 8, a pair of triangular shaped guide tabs 110 are stitched to the base of the zipper 67 that runs vertically along the front of the body portion 62. An eyelet 112 is formed in opposite sides of each of the pair of guide tabs 10. A continuous cinching (e.g., bungee) cord 114 is first received through the eyelets 112 at one side of the guide tabs 110, then laced in a criss-cross pattern through each of the cord loops (104 in FIG. 10) of the cord holders 98 along the sides of the body portion 62, and finally received through the eyelets 112 at the opposite side of the guide tabs 110. The free ends of the cinching cord 114 are fed through a push button operated cord stopper 116. A bungee-type cinching cord 114 will allow the wearer to stretch his legs without damaging, the protective pod 60.

FIG. 11 of the drawings shows the protective body heat retaining pod 60 of this invention after the wearer has entered the water and climbed into the body portion 62. In this case, the wearer has tightened the hood 90 over his head and around his face, moved the water tight zipper 37 vertically upward to the closed position, and closed the collar wrap 84 around his neck. To minimize the volume of water that will be trapped within the protective pod 60, the length and width of the body portion 62 is effectively shortened and compressed by drawing the wearer's feet markedly upward and into a fetal position. To accomplish the foregoing, the wearer pulls upwardly on the free ends of the cinching cord 114 at the same time that he momentarily opens the cord stopper 116. Accordingly, the cinching cord 114 will slide upwardly through the eyelets 112 in guide tabs 110 to correspondingly pull the seam 64 that runs along the bottom of pod 60 in an upward direction towards the wearer's chest. At the same time that the bottom of the pod 60 is pulled upwardly, the criss-cross pattern of the cinching cord 114 that has been laced between successive cord holders 98 will cause the bottom of the protective body heat retaining pod 60 to be pulled inwardly around the wearer's legs and waist and thereby reduce the empty space within the body portion 62 thereof. The cord stopper 116 is then released and closed to prevent the ends of the cinching cord 114 from sliding downwardly through the guide tabs 110 to extend the pod 60 back to its elongated configuration of FIG. 8. An additional benefit of the cinching cord 114 holding the protective pod 60 in the shortened and inwardly compressed configuration of FIG. 11 is to enable the wearer to maintain the fetal position without having to unnecessarily expend energy that might otherwise speed up the loss of his body heat and a drop in his body temperature. Lastly, the wearer secures the water-tight wrist wraps 70 (of FIG. 8) around cuffs 66 and places the tethered gloves 74 over his hands.

By virtue of the modification disclosed above, the wearer's torso and legs are now fully enclosed by a virtually water-tight protective body heat retaining pod 60 which is used in combination with a standard life jacket 50 to keep him afloat in a cold water environment while reducing the loss of life sustaining body heat and thereby prolonging his resistance to hypothermia while increasing his chances for surviving and being rescued from a life threatening emergency situation. Although the combination backpack 1 and protective body heat retaining pod 60 have been described above primarily for use by a wearer who finds himself in a cold water environment, this same combination may also be used by those outside of water who seek protection from the elements while awaiting their rescue from an emergency and possibly life-threatening situation (e.g., including those who are lost in the wilderness or adrift in a boat floating upon the sea).

I claim:

1. In combination:

a backpack;

a harness to surround a wearer, said harness having a front and a back, and said backpack being carried by said harness at the back thereof;

a protective body heat retaining pod adapted to be folded into a compact package to be carried within said backpack and removed from said backpack to be unfolded and worn by the wearer should he find himself surrounded by a body of water while awaiting rescue from an emergency situation, said backpack including a cover to be moved between opened and closed positions to control access to said protective body heat retaining pod that is carried within said backpack; and a rip cord running from the cover of said backpack to the front of said harness, such that a pulling force applied to said rip cord causes said cover to move to the opened position to permit access to said protective body heat retaining pod without first having to remove the backpack or the harness from the wearer.

2. The combination recited in claim 1, wherein said harness to surround the wearer and carry said backpack includes at least one shoulder strap to be received under an arm and over a shoulder of the wearer and a belt that extends around the waist of the wearer.

3. The combination recited in claim 1, also including a tether running from said protective body heat retaining pod within said backpack to the front of said harness, such that a pulling force applied to said tether causes said protective body heat retaining pod to be pulled outwardly from said backpack after the cover of said backpack has first been moved to the opened position.

4. The combination recited in claim 3, also including a handle at the front of said harness, each of said rip cord and said tether connected to said handle, such that a pulling force applied to said handle applies a corresponding pulling force to said rip cord and said tether, whereby to cause the cover of said backpack to move to the opened position and said protective body heat retaining pod to be pulled outwardly from said backpack.

5. The combination recited in claim 4, including respective complementary fasteners located on said handle and the front of said harness for detachably connecting said handle to said harness so as to be easily accessible to the reach of the wearer.

6. The combination recited in claim 1, wherein said protective body heat retaining pod comprises a body portion having a front and a back for surrounding the legs and torso of the wearer, and a hood attached to the back of said body portion to surround the head of the wearer, said body portion being sized to trap therewithin a small volume of water from the wearer's surroundings to be heated by the body heat of the wearer in order to slow the rate at which the body temperature of the wearer drops while awaiting rescue.

7. The combination recited in claim 6, wherein said protective body heat retaining pod also comprises a wrap-around collar attached to the back of said body portion, said wrap-around collar having first and opposite flaps manufactured from a resilient material and adapted to be stretched around said hood and diagonally across the front of said body portion to prevent water from the wearer's surroundings from entering said body portion.

8. The combination recited in claim 6, wherein said protective body heat retaining pod also comprises a water-tight zipper extending in a vertical direction along the front of the body portion of said protective body heat retaining pod by which to enable the wearer to don said pod and then close said body portion around his legs and torso, while trapping within said body portion said small volume of water to be heated by the wearer's body heat.

9. The combination recited in claim 6, wherein said protective body heat retaining pod also comprises a pair of sleeves attached to and projecting outwardly and in opposite directions from the body portion of said protective body heat retaining pod to receive the arms of the wearer therethrough, and a pair of cuffs attached to respective ones of said pair of sleeves and adapted to be tightened around and closed against the wearer's wrists to prevent water from entering said body portion by way of said sleeves.

10. The combination recited in claim 9, wherein each of said pair of cuffs attached to said pair of sleeves has a cylindrical cuff body to surround the wearer's wrists, an axially projecting tongue to be held by the wearer to prevent the cuff body from rotating around the wearer's wrist, and a radially projecting wrist wrap that is adapted to be wound around the cuff body and over itself, whereby the cuff body is tightened against the wearer's wrist to prevent water from entering the sleeve to which the cuff is attached.

11. The combination recited in claim 6, wherein said protective body heat retaining pod also comprises a cinching cord attached to the front of the body portion of said protective body heat retaining pod and a guide at the front of said body portion for receiving and holding said cinching cord, such that when the wearer pulls said cinching cord upwardly relative to said guide, said body portion is correspondingly pulled upwardly to draw and hold the wearer's legs in a fetal position in order to reduce the size of said body portion and minimize the volume of water to be trapped and heated therewithin.

12. The combination recited in claim 11, wherein said protective body heat retaining pod also comprises a plurality of cord holders located at the front of the body portion of said protective body heat retaining pod and on each side thereof, said cinching cord running along the front of said body portion in a criss-cross pattern between successive ones of said plurality of cord holders to cause said body portion to be pulled inwardly around the wearer's legs and waist at the same time that said body portion is pulled upwardly in response to said cinching cord being pulled upwardly.

13. The combination recited in claim 12, wherein each of said plurality of cord holders includes a strip of material that is folded over itself to create a cord loop through which to slideably receive said cinching cord, said folded over strip of material being stitched together and to the exterior at one side of the body portion of said protective body heat retaining pod.

14. The combination recited in claim 13, also including a layer of resilient material attached to the interior of the body portion of said protective body heat retaining pod below said folded over strip of material which forms said cord loop, said layer of resilient material receiving and closing the stitch holes when said folded over strip of material is stitched to the exterior of said body portion so as to prevent water from the wearer's surroundings from seeping into said body portion.

15. In combination:

a protective body heat retaining pod adapted to be folded into a compact package so as to be carried by a wearer and unfolded so as to be worn by the wearer should he find himself surrounded by body of water while awaiting rescue from an emergency situation, said protective body heat retaining pod comprising a body portion having a front and back for surrounding the legs and torso of the wearer and for trapping therewithin a small volume of water from the wearer's surroundings to be heated by the body heat of the wearer to slow the rate at which the body temperature of the wearer drops while awaiting rescue;

a cinching cord attached to the front of the body portion of said protective body heat retaining pod and a guide at the front of said body portion for receiving and holding said cinching cord, such that when the wearer pulls said cinching cord upwardly relative to said guide, said body portion is correspondingly pulled upwardly to draw and hold the wearer's legs in a fetal position in order to reduce the size of said body portion and minimize the volume of water to be trapped and heated therewithin; and a backpack positioned at the back of the wearer within which to carry said protective body heat retaining pod in a folded condition.

16. The combination recited in claim 15, also including a harness to surround the wearer, said harness having a front and a back, and said backpack being carried by said harness at the back thereof.

17. The combination recited in claim 15, wherein said protective body heat retaining pod also comprises a hood attached to the back of said body portion to surround the head of the wearer while leaving the face of the wearer exposed.

18. The combination recited in claim 15, also including a plurality of cord holders located at the front of the body portion of said protective body heat retaining pod and at each side thereof, said cinching cord running along the front of said body portion in a criss-cross pattern between successive ones of said plurality of cord holders to cause said body portion to be pulled inwardly around the wearer's legs and waist at the same time that said body portion is pulled upwardly in response to said cinching cord being pulled upwardly.

19. In combination:

a protective body heat retaining pod adapted to be folded into a compact package so as to be carried by a wearer and unfolded so as to be worn by the wearer should he find himself surrounded by a body of water while awaiting rescue from an emergency situation, said protective body heat retaining pod comprising a body portion having a front, a back, a bottom and opposite sides for surrounding the legs and torso of the wearer and for trapping therewithin a small volume of water from the wearer's surroundings to be heated by the body heat of the wearer to slow the rate at which the body temperature of the wearer drops while awaiting rescue, said body portion also having a cinching cord attached to the bottom and opposite sides thereof, such that a pulling force applied to said cinching cord causes said body portion to be compressed upwardly and inwardly to reduce the volume of water trapped within said body portion;

a backpack within which to carry said protective body heat retaining pod in a folded condition; and a harness to surround the wearer and carry said backpack.

20. In combination:

a backpack;

harness to surround a wearer, said harness having a front and a back, and said backpack being carried by said harness at the back thereof;

a protective body heat retaining pod adapted to be folded into a compact package to be carried within said backpack and removed from said backpack to be unfolded and worn by the wearer should he find himself surrounded by a body of water while awaiting rescue form an emergency situation; and a tether connected from said protective body heat retaining pod within said backpack to said harness, such that a pulling force applied to said tether causes said protective body heat retaining pod to be pulled outwardly from said backpack, said tether preventing said protective body heat retaining pod from becoming separated from said harness and lost by the wearer.

21. The combination recited in claim 20, wherein said backpack includes a cover to be moved between opened and closed positions to control access to said protective body heat retaining pod that is carried within said backpack, said combination also including a rip cord extending from the cover of said backpack to the front of said harness such that a pulling force applied to said rip cord causes said cover to move to the opened position to permit said protective body heat retaining pod to be pulled outwardly from said backpack by means of said tether without first having to remove the backpack or the harness from the wearer, and a handle located at the front of said harness, said rip cord and said tether connected to said handle such that a pulling force applied to said handle applies said pulling force to each of said rip cord and said tether, whereby to cause the cover of said backpack to move to the opened position and said protective body heat retaining pod to be pulled outwardly from said backpack.

* * * * *